United States Patent [19]

Leandris

[11] 4,287,665

[45] Sep. 8, 1981

[54] DEVICE FOR FITTING THE ENDS OF ELECTRICAL CONDUCTORS OR SIMILAR ELEMENTS INTO A BOX

[75] Inventor: Sergio Leandris, Saint-Sauveur, France

[73] Assignee: Precision Mecanique Labinal, France

[21] Appl. No.: 87,934

[22] Filed: Oct. 25, 1979

[30] Foreign Application Priority Data

Oct. 25, 1978 [FR] France ..... 78 30352

[51] Int. Cl.[3] ..... H01R 43/00

[52] U.S. Cl. ..... 29/705; 29/715

[58] Field of Search ..... 29/715, 754, 705

[56] References Cited

U.S. PATENT DOCUMENTS 3,063,139 11/1962 Maximoff ..... 29/715 X
3,170,231 2/1965 Gleason ..... 29/715
3,216,097 11/1965 Stricker ..... 29/715 X
3,263,316 8/1966 Schrader ..... 29/715 X
3,289,284 12/1966 Zent ..... 29/715 X
3,597,824 8/1971 Yoshida ..... 29/715 X
3,964,147 6/1976 Fusco ..... 29/715

*Primary Examiner*—Jimmy C. Peters
*Attorney, Agent, or Firm*—Ostrolenk, Faber, Gerb & Soffen

[57] ABSTRACT

The plugging into a box having several recesses of the ends, having generally crimped connections, of electrical conductors is provided. A box carrier brings a box with a socket into a position fixed in space opposite the connection to be plugged in. This connection is brought into the plugging-in position by means of a gripper actuated by a drum moved by a carriage and acting on a plate which moves the pushrods recalled by springs. The invention applies to the automatic plugging in of electrical conductors.

10 Claims, 12 Drawing Figures

DEVICE FOR FITTING THE ENDS OF ELECTRICAL CONDUCTORS OR SIMILAR ELEMENTS INTO A BOX

The present invention relates to the plugging in of the ends, generally provided with crimped connections, of electrical conductors or similar elements into a box, generally provided with several recesses or sockets intended to receive such ends.

The device of the invention has as its aim to permit the plugging in (with snap fitting in position), into a box, of the ends of electrical conductors or similar elements.

The invention applies more particularly to the automatic plugging in of a large number of conductors or wires, identical or different, into a box, with snap fitting of the end of each wire into a recess provided for this purpose in the box, the conductors or wires being plugged in or inserted in a predetermined order, each one in a predetermined recess of the box.

The box may comprise one or more rows of sockets or recesses, or else sockets disposed in different configurations (relay connectors or connectors for supplying car headlamps, for example).

Preferably the plugging in or insertion device according to the invention comprises means for checking the correct snap fit of each conductor plugged in.

It should be noted that:

the device according to the invention allows, due to its structure, to realize the plugging in of contacts or end-sleeves (provided at the extremity of conductors, wire or leads) of any type-and even of bared conductors-in boxes with any configuration of the recesses or holes;

whereas the prior art devices, e.g. those disclosed in U.S. Pat. No. 3,964,147 issued June 22, 1976 and French Pat. Nos. 2,351,517, 2,378,381 and 2,134,803, do allow the plugging in only of precisely determined types of contacts or end-sleeves in a single type of box having a well determined row of recesses or holes, without any possibility of orientation of the box.

In accordance with the invention, a device for plugging in the ends of electrical conductors or similar elements into a box is characterized by the fact that it comprises, in combination with a fixed supply corridor, adapted to supply a succession of boxes suitably orientated, and a conductor or wire transporter, adapted to bring in a predetermined order a succession of conductors comprising at least one free end, with the free end of each successive conductor in a very definite position, on the one hand, a box carrier comprising means for receiving a box from the supply corridor and means for bringing this box into a predetermined succession of well-defined fixed positions, in each of which a well-defined recess or socket of said box occupies a fixed position in space, and means for releasing the box once provided with its conductors, and on the other hand, a unit for feeding and plugging in the successive conductors or wires comprising grasping means adapted to grasp and release a conductor, means for bringing these grasping means opposite the conductor brought into position by a transporter, means for controlling the grasping of said conductor by said grasping means, means for bringing said grasping means, with the conductor which they have grasped, opposite said fixed position in space occupied by said well-defined recess of said box, means for moving said grasping means so as to plug said free conductor end grasped in said recess and to ensure the snap fit of this end in the socket, and means for releasing said conductor from said grasping means, when these latter occupy a predetermined position.

Preferably, the feeding and plugging-in unit comprises checking means which, after plugging in of a conductor, check whether the snap fit of the conductor in the box resists a definite strain and means which only release the conductor from said grasping means in said predetermined position when said checking means have checked that the snap fit is correct.

In a first embodiment, for equipping boxes able to comprise one or more rows of sockets, said box carrier comprises means for moving said box along two orthogonal paths, in both directions, one path corresponding to the passage from one recess or socket to the next one in the same row and the other path to the passage from one socket of one row to a socket of another row.

In a second embodiment, for equipping boxes able to comprise sockets disposed in any configuration, the box carrier comprises means for moving said boxes along two orthogonal paths, in both directions, and in rotation, preferably also in both directions.

The invention will, in any case, be well understood with the help of the complement of description which follows, as well as the accompanying drawings, which complement and drawings are, of course, given especially by way of indication.

In FIG. 8 the gripper is in the open position and in FIG. 9 the gripper is in the closed position on a conductor.

Figure 12:
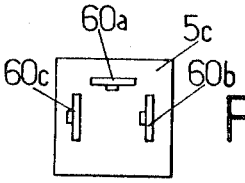

FIG. 12, finally, shows a box comprising three unaligned sockets.

The plugging in device of the invention is intended to cooperate with two feeding devices, one feeding boxes, the other conductors or wires.

The device for bringing the boxes is formed by a fixed supply corridor A (FIG. 2) adapted to supply a succession of suitably orientated boxes. This corridor receives, through its side opening 1, suitably orientated boxes 5 from a distributor of conventional design, (not shown) for example the vibrating type, and a feeding ramp 2 which receives the boxes from the vibrating distributor in a certain direction and feeds them to opening 1.

The supply corridor 1 is provided with a pusher 3 actuated by a jack 4 which moves the boxes 5 in the direction of arrow F to bring them successively to position 5*a*. Corridor A serves then to change the orientation (by 90°) of the boxes coming from the vibrating distributor over the feeding ramp 2 and to bring them thus orientated into position 5*a*.

Figure 11:
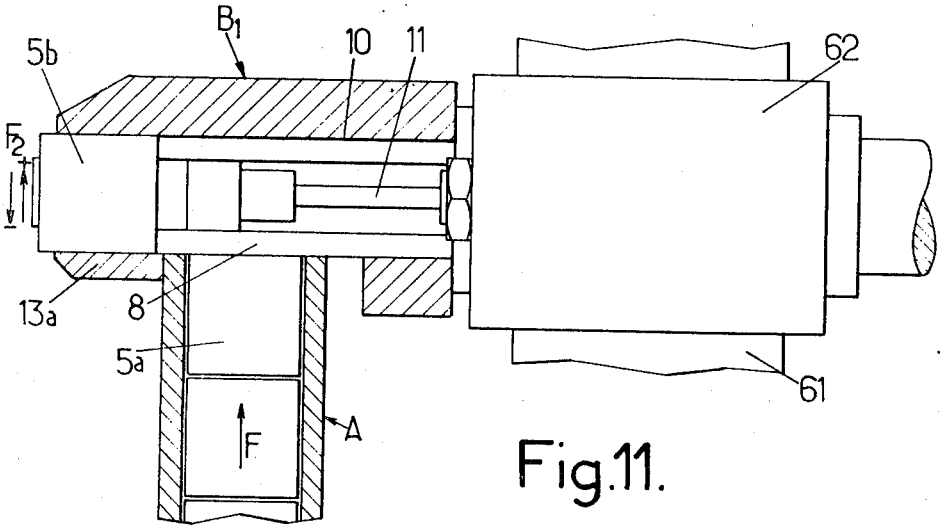

In FIG. 11 there can also be seen a portion of corridor A with a box in position 5*a*.

Figures 4, 5:
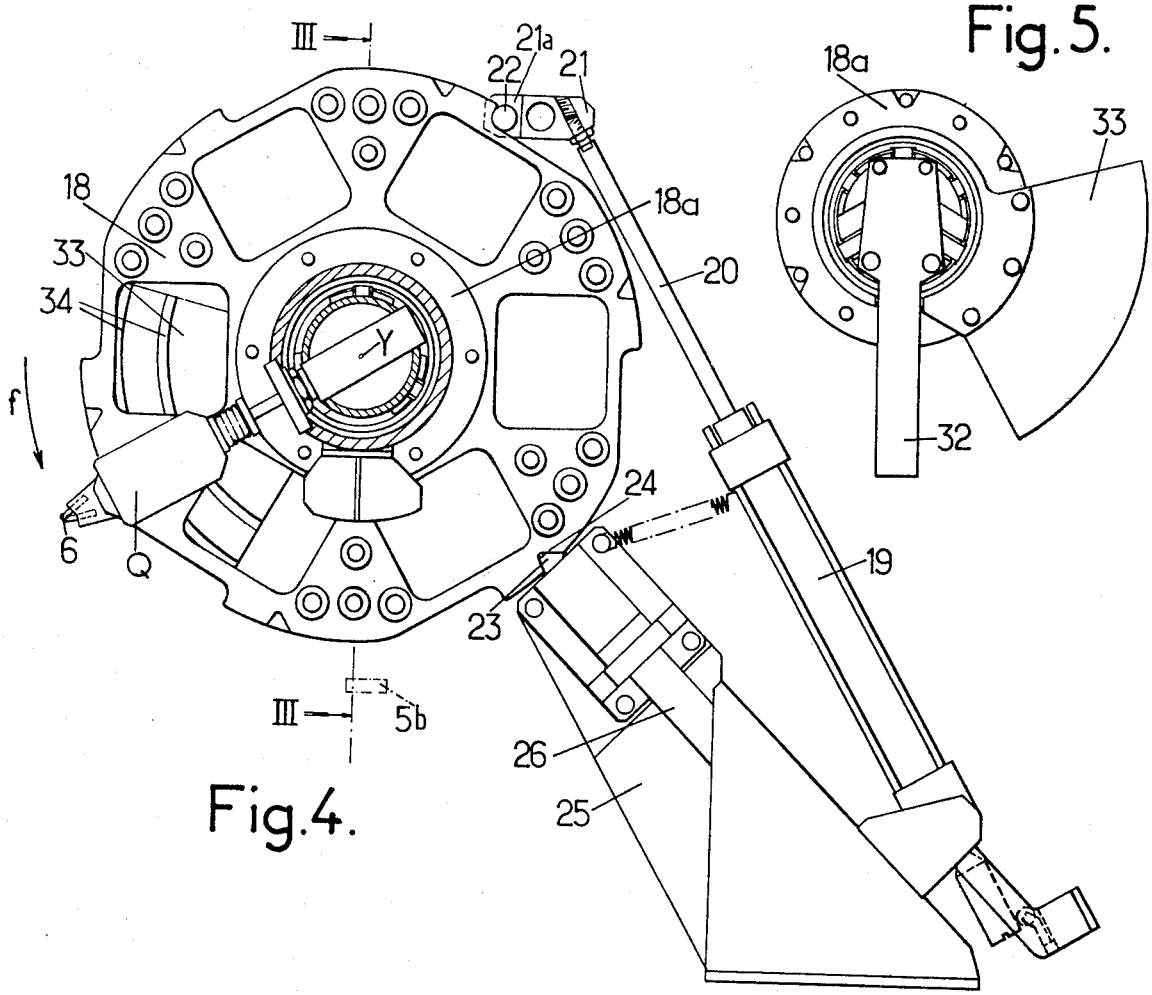
FIG. 4 is a section along IV—IV of FIG. 3 looking in the direction of arrows IV—IV.
FIG. 5 is an end view looking in the direction of arrow V of FIG. 3.

As for the device for bringing the conductors or wires, it is formed by a transporter (not shown) adapted to bring, in a predetermined order, a succession of wires comprising at least one free end, with the free ends of each successive wire or conductor in a well-defined position, i.e. 6 in FIG. 4. Generally this free end is a bared end on which is crimped a conducting connection or sleeve connector 7 (FIG. 6) adapted to be plugged and snap-fitted in one of the recesses or sockets provided in boxes 5.

The conductors or wires to be plugged in may be either identical with each other in the same series intended for the same box, or differ in the series intended for the same box, the difference concerning either the nature, the section or the colour of the conductors or wires.

Figure 1:
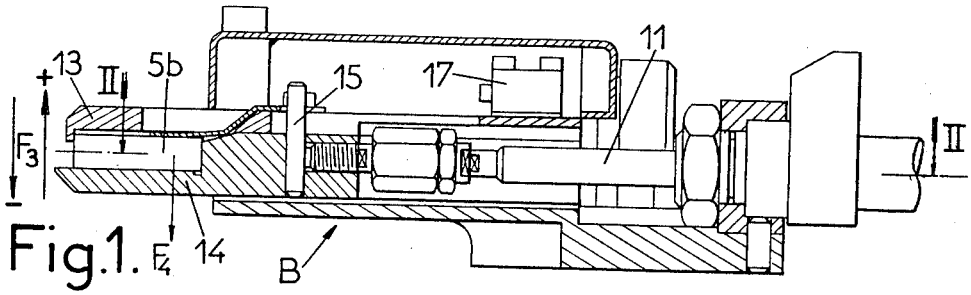
FIG. 1 is a side elevation and partial section along line I—I of FIG. 2 looking in the direction of arrows I—I, of the box carrier of a device constructed according to a first preferred embodiment of the invention.
Figure 2:
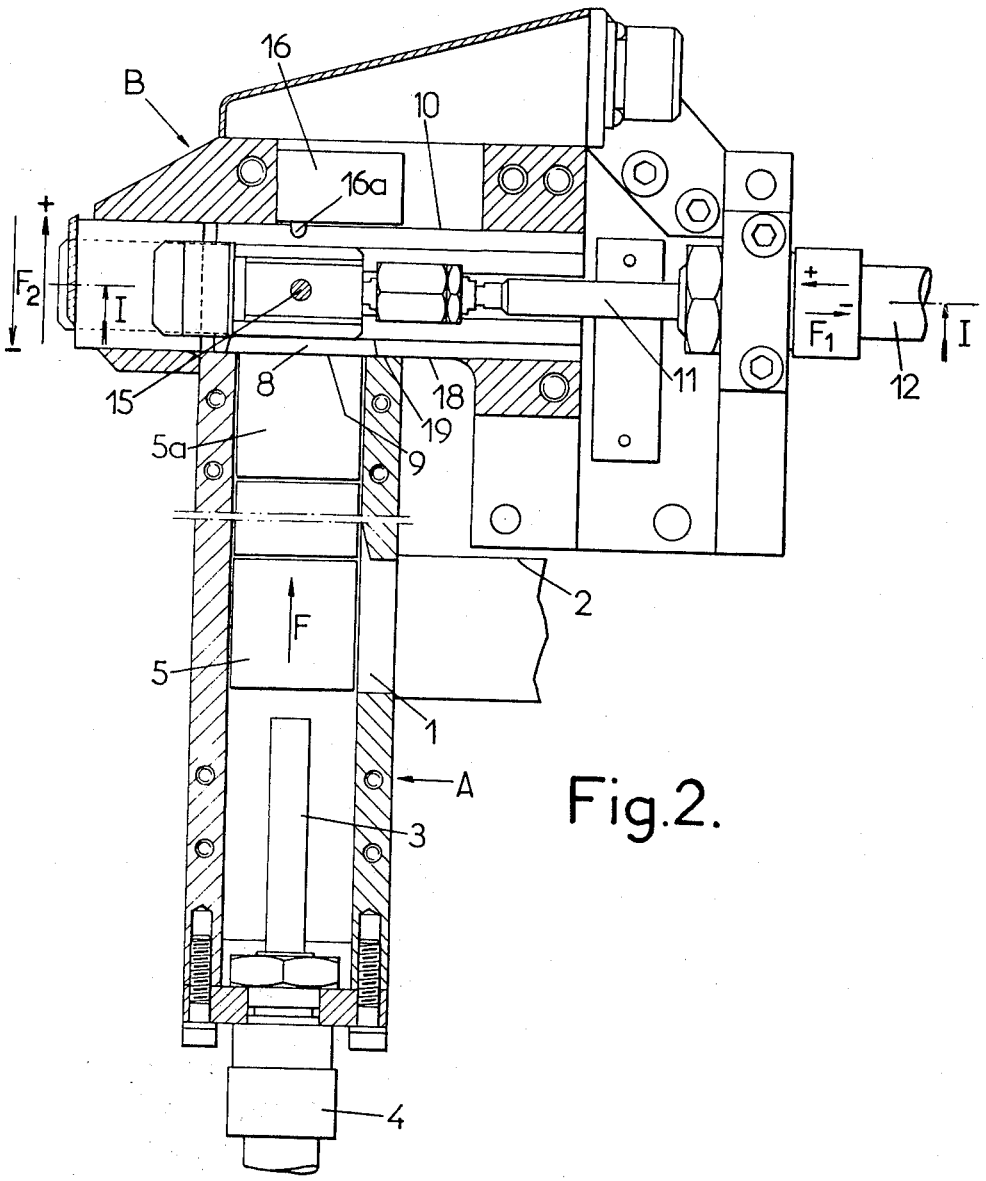
FIG. 2 is a cross-section taken through line II—II of FIG. 1 looking in the direction of arrows II—II.
Figure 3:
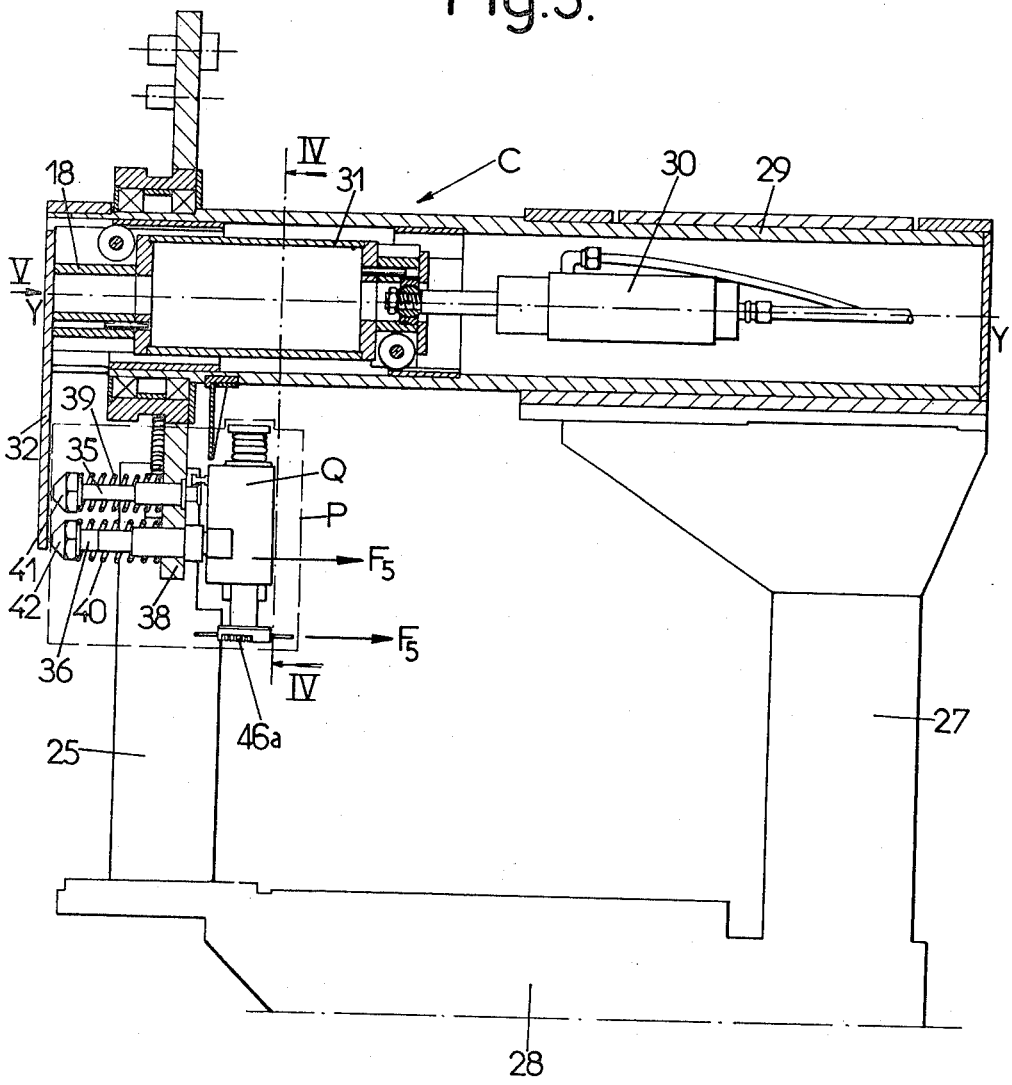
FIG. 3 shows in side elevation, with a partial section along III—III of FIG. 4 looking in the direction of arrows III—III, the unit for feeding and plugging in conductors which comprises the device according to the first embodiment.
Figure 8:
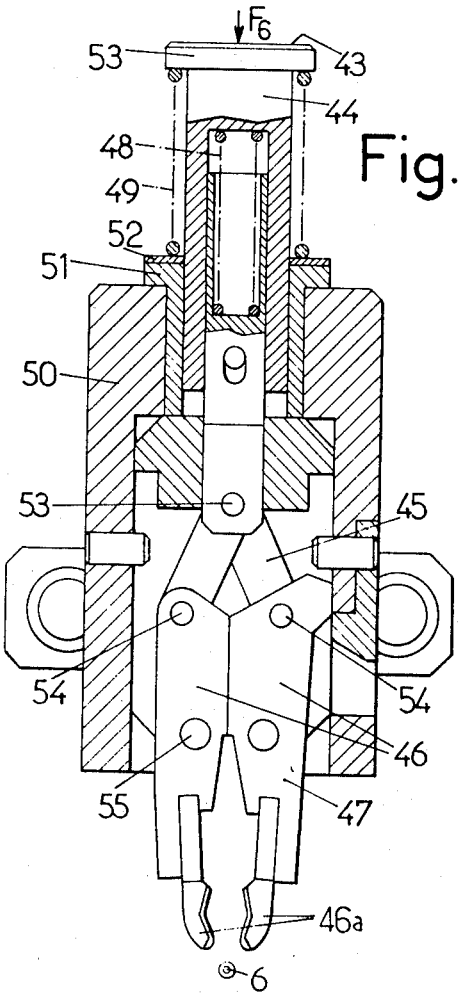
FIGS. 8 and 9 show in section and on a larger scale, a gripper forming the grasping means O of the unit of FIG. 3.
Figure 9:
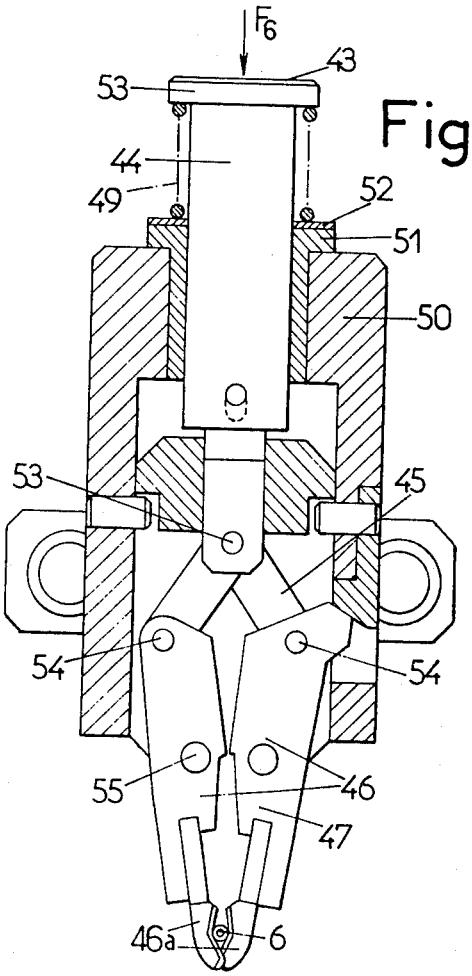
Figure 10:
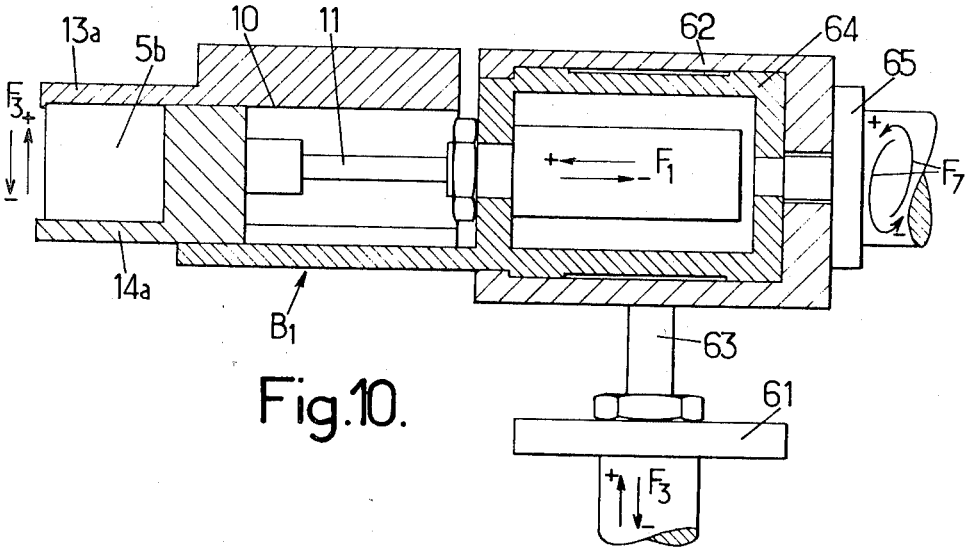
FIGS. 10 and 11 are views similar to FIGS. 1 and 2 respectively showing a second preferred embodiment of the invention.

The device of the invention itself comprises two parts, i.e. a box carrier B, illustrated in FIGS. 1 and 2 for a first embodiment and FIGS. 10 and 11 for a second embodiment, and a unit C for feeding and plugging in the conductors, illustrated in FIG. 3, as well as in FIGS. 4 to 9, this last device C comprising advantageously means for checking that the snap fit has been correctly effected.

There will be described first of all, with reference to FIGS. 1 and 2, the box carrier B according to a first embodiment.

Box carrier B comprises an introduction opening 8 adapted to come against the discharge opening 9 of supply corridor A (FIG. 1), so as to allow the passage of the boxes, in position 5*a*, from supply corridor A to said box carrier B. This box carrier has therethrough a bore 10 which communicates with opening 8 for the passage of the boxes and in which moves a pusher 11 actuated by a jack 12 for moving in bore 10. The left-hand end of box carrier B comprises means for enclosing a box in the plugging-in position of the conductors. These means comprise, on the one hand, a tunnel 13 which surrounds box 5*b*, in position, on four faces, and a slide 14 which limits box 5*b* on its rear face and on its lower face (as viewed in FIG. 1), slide 14 being fixed by a pin 15 to pusher 11 so as to move therewith.

There are also provided two micro-contacts, i.e. a micro-contact 16 (FIG. 2) whose sensitive element 16*a* detects the correct entry of a box, from its position 5*a*, into bore 10 and a micro-contact 17 (FIG. 1) which detects the position of pusher 11.

The different movements are provided as follows:

the movement of pusher 11, in the positive or negative direction according to arrow $F_1$, by jack 12, is controlled by pulses sent by a central control station (not shown), formed advantageously by a programmable automaton, the movement of the whole of the box carrier, in the positive or negative direction along arrow $F_2$, is achieved by means of a ball screw rotated by a step-by-step motor, the control of this motor being provided by electric pulses also from the central control station, the movement, in the positive or negative direction along arrow $F_3$, is provided by a vertical jack (not shown) whose amplitude may be adjusted by means of a finely graduated vernier, this jack being controlled, like the step-by-step motor, from the central control station.

The operation of the box carrier is the following.

The box carrier B is first of all brought into the position illustrated in FIG. 2, by moving in the negative direction of arrow $F_2$, to receive a box from corridor A, face 18 of box carrier B being against the face 19 of the introduction corridor A with correspondence between openings 9 of A and 8 of B.

Pusher 3, under the action of jack 4, also controlled by said central station, causes a box, namely the one in position 5*a*, to penetrate into bore 10, pusher 11 then occupying not the position illustrated in FIGS. 1 and 2, but a position set back to the right; this set-back position is detected by micro-contact 17 which causes actuation of jack 4 and so the arrival of the box into bore 10.

The arrival in position in bore 10 of a box is detected by contact 16 which causes actuation of jack 12, pusher 11 being driven in the positive direction of arrow $F_1$. Pusher 11 with slide 14 moves in the positive direction $F_1$ moving the box in bore 10 into position 5*b*, the pusher 11 and slide 14 then occupying the position shown in FIGS. 1 and 2. Box 5*b* is completely fixed in the space because it is hemmed in on its six faces by tunnel 13 and slide 14. It occupies first of all a position in which a first socket is ready to receive the first conductor or wire to be plugged in (as that will be explained hereafter with reference to FIGS. 3 to 9 possibly after movement in one of the directions $F_2$).

After the plugging in of the first wire, the above mentioned step-by-step motor moves the box, in position 5*b*, by a notch in one of the directions $F_2$ so as to bring the following socket into the plugging-in position. The operation is repeated until all the sockets of one of the rows or of the single row of box 5*b* have received a conductor.

It is assumed in fact that the box comprises one or more rows of sockets (the case of the embodiment of FIGS. 1 and 2 for the box carrier).

If the box comprises several rows, the programmable automaton causes the movement in one of directions $F_3$ of box carrier B to bring a socket of the following row into position, movements in direction $F_2$ enabling conductors to be plugged into the successive sockets of this second row.

After the single row or each row of the box in position 5*b* has received its conductor, the slide 14 is brought back (negative direction $F_1$) under the control of jack 12 and the box fitted with the conductors falls (arrow $F_4$, FIG. 1). Box carrier B is brought back against corridor A and a new cycle begins, micro-contact 17 having detected that pusher 11 has come back to its set back position.

There will now be described, with reference to FIGS. 3 to 9, the unit for feeding and plugging in the conductors which are brought to point 6 (FIG. 4) by means not shown which are outside the invention.

Said unit comprises first of all a drum 18, which can be seen in side elevation in FIG. 4, adapted to turn with its flange 18*a* about axis YY under the control of a jack 19 whose mobile piston rod 20 acts, on drum 18, to rotate this latter in the direction of arrow f by means of a rigid finger 21 fixed to the free end of piston rod 20. Finger 21 comprises a trunion 22, mobile in rotation, situated between two cheeks 21*a* disposed on each side of drum 18 and ensuring the centering.

Drum 18 may occupy for example six rest positions, the angular displacement between two successive rest positions being 60°. Each angular position is exactly located thanks to a pin or pawl 23 cooperating with six notches 24 angularly displaced by 60° provided on the periphery of drum 18. Pin 23 is carried by an upright 25 which also carries jack 19; pin 23 is actuated by another jack 26.

The unit of FIG. 3 for feeding and plugging in the conductors is carried by an upright 27 (which, like upright 25, is supported by base 28) and comprises a cylinder 29 bored to receive, on the one hand, a jack 30 controlled, like jack 19, from the central control station and, on the other hand, a carriage 31 actuated by said jack 30, carriage 31 being adapted to move a plate 32 (FIGS. 3 and 5). Said unit comprises furthermore six grasping means Q each formed by a gripper illustrated in more detail in FIGS. 6, 8 and 9 and which will be described hereafter, this gripper serving to grasp and transport the conductors to be plugged in (a single gripper is shown in FIG. 4).

This gripper is actuated by a cam 33 (FIGS. 4 and 5) comprising two bosses 34 (FIG. 4) in the form of ramps, as well as said plate 32 acting through pushrods 35 and 36 (FIG. 3) which are shown on a larger scale in FIGS. 6 and 7 and which will be described in detail hereafter.

Figure 6:
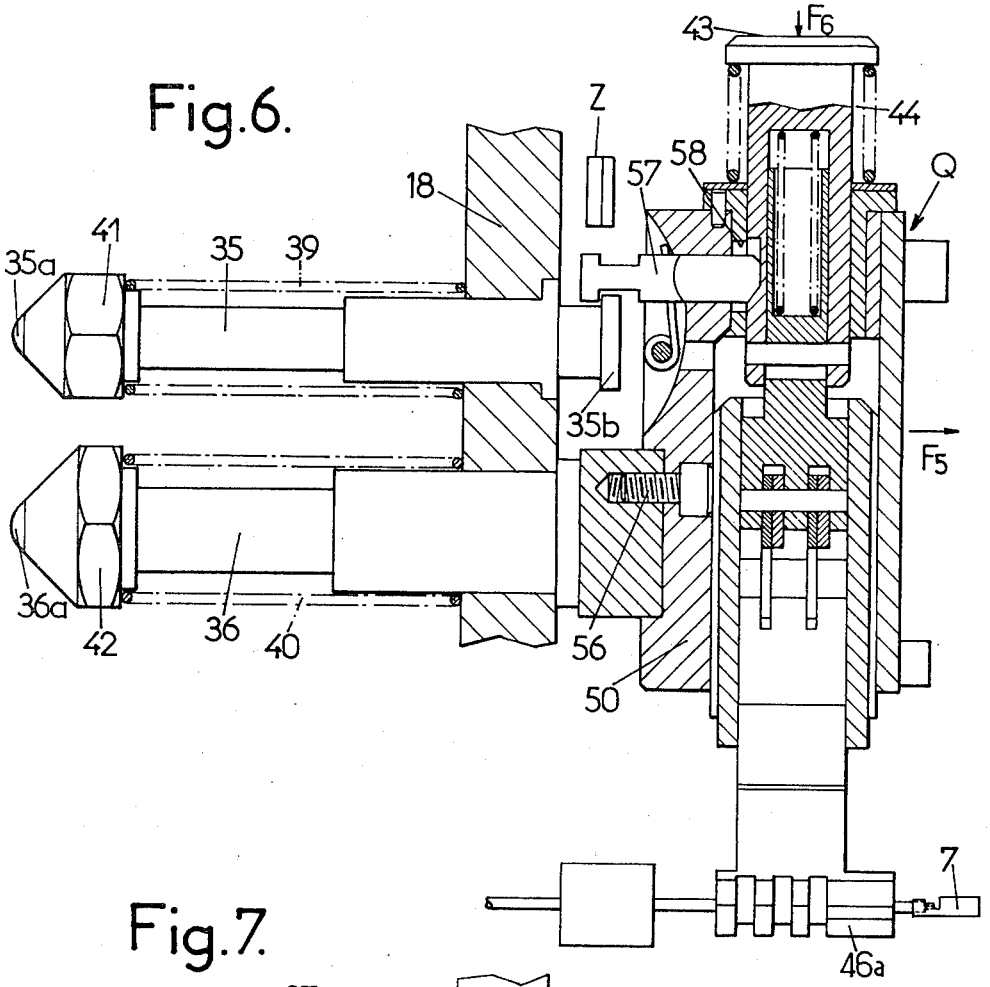
FIG. 6 is a section along VI—VI of FIG. 7 looking in the direction of arrows VI—VI, showing an enlarged detail of a portion of FIG. 3 (i.e. part P thereof).
Figure 7:
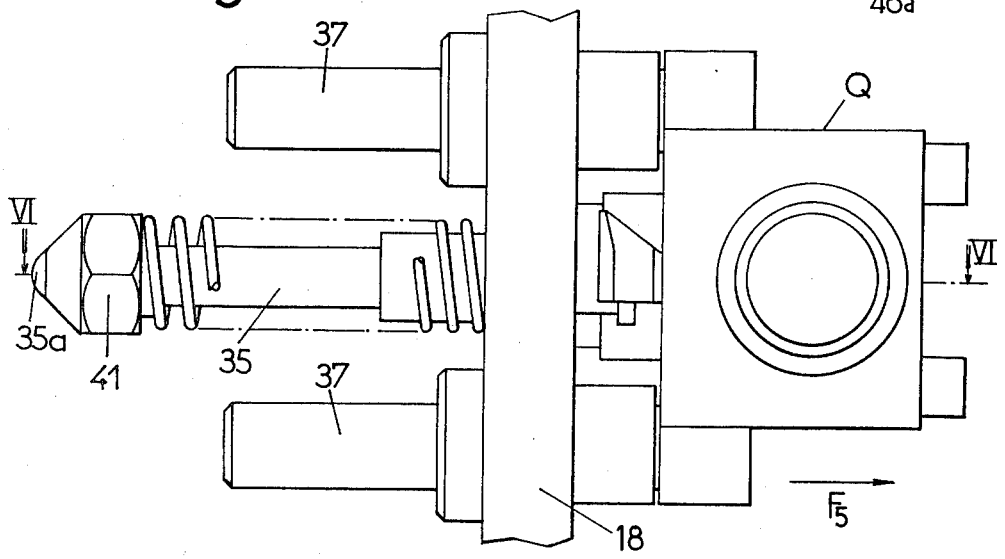
FIG. 7 is a plan view of the elements of FIG. 6.

Referring to FIGS. 6, 8 and 9, there will now be described the structure of the gripper forming the grasping means Q and pushrods 35 and 36.

The gripper (FIGS. 6, 8 and 9) is carried by drum 18 through the medium of two posts 37 (FIG. 7) which may slide in bores provided in the drum, the gripper forming the grasping means Q able to move in the direction of arrow $F_5$ or in the reverse direction, with posts 37 sliding in the bores of the drum. It will be seen that it is the action either of plate 32, or of bosses 34 of cam 33 on the ends 35*a* and 36*a* of pushrods 35 and 36 which ensures this action in the direction of arrow $F_5$, the movement in the reverse direction of the gripper taking place under the effect of compression springs 39 and 40 disposed between the heads 41 and 42, respectively, of pushrods 35 and 36 and plate 38.

The gripper may also move in the direction of arrow $F_6$ (FIG. 6) under the effect of means (not shown) acting on the rear face 43 of pusher 44, these means being controlled by the central control member. The action in the direction of arrow $F_6$ of pusher 44 is transmitted by connecting rods 45 to the jaws or claws 46 of the gripper, a spring 48 being housed in pusher 44; a second spring 49 is provided around this pusher. The lower part of the pusher and the upper part of the gripper jaws 46 as well as connecting rods 45, are housed in a casing 50 provided at its upper part with a sleeve 51 whose upper face 52 serves as a bearing surface for the lower end of spring 49, the upper end of this spring acting on the head 53 of pusher 44. The jaws 46 of gripper 47 end in curved grasping pieces 46*a* which are adapted to grasp the conductor 6 and which are to be found in FIGS. 3 and 6.

The operation of the unit for feeding and plugging in conductors such as illustrated in FIGS. 3 to 9 is the following.

With drum 18 occupying a defined rest position, jack 19 is actuated to extend its piston rod 20 thereby rotating drum 18 by a sixth of a revolution in the direction of arrow f, the new position (which is for example that shown in FIG. 4) of the drum 18 being positively fixed by penetration of pin 23 into notch 24 owing to jack 26. During this rotation by a sixth of a revolution, the bosses 34 of cam 33 move the pushrods 35 and 36, which results in moving gripper Q. It moves (35 mm for example) in the direction of arrow $F_5$. On its arriving in the position shown in FIG. 4, a jack (not shown) housed in tube 29 acts on the gripper (which is initially in position of FIG. 8) in the direction of arrow $F_6$ (FIG. 6), which causes jaws 46 to close (FIG. 9) and to grasp a conductor in position 6. Once this latter has been grasped, jack 19 controls a second 60° rotation of drum 18, which brings gripper Q shown in FIG. 4 into a vertical position, the rotation having taken place in the direction of arrow f. In this position, which is the one shown in FIG. 3, gripper Q is in a plugging-in position. Of course, during this rotation the next gripper (not shown) has arrived in the grasping position and grasps a new wire disposed at 6. It will be noted that in the position shown in FIG. 4, the conductor or wire presents a certain "slack", i.e. it is not completely stretched, for the pushrods 35 and 36 are no longer opposite bosses 34 and the gripper Q has moved back in the reverse direction of that of arrow $F_5$.

After explaining the movement of gripper Q, it will now be described how this latter can effectively grasp the wire.

Gripper Q is open (position shown in FIG. 8) until its arrival in the position shown in FIG. 4 in which it is to grasp the wire or conductor at position 6. When the gripper has arrived in the position shown in FIG. 4, the central control member actuates the jack situated in tube 29 and this jack applies a force in the direction of arrow $F_6$ on face 43 of the gripper, causing a movement in the same direction of pusher 44, which results in (through the connecting rods 45, articulated, on the one hand, at 53 to the pusher and, on the other hand, at 54 to the jaws 46, themselves pivotable about axes 55) the closing of the gripper which assumes the position of FIG. 9; in FIG. 8 there is shown at 6 the conductor which will be grasped or which has just been grasped (FIG. 9).

In short, in the position 60° upstream of that shown in FIG. 4, gripper Q is open. During its passage from this position to the position shown in FIG. 4, the gripper remains open but moves in the direction of arrow $F_5$ under the effect of bosses 34. Arriving in the position of FIG. 4, gripper Q closes under the effect of a thrust in the direction of arrow $F_6$ and passes from the condition of FIG. 8 to the condition of FIG. 9; then gripper Q moves back in the reverse direction of that of arrow $F_5$ while passing to the downstream position displaced by 60° in the direction of arrow f in relation to the position of FIG. 4 and assumes the position of FIG. 3 in which it presents the end sleeve connector 7 of conductor 6 just opposite the socket or recess to be supplied of box 5*b* held in position by the box carrier B (FIGS. 1 and 2). At this moment, sleeve connector 7 must be moved in the direction of arrow $F_5$ to accomplish the plugging in.

This movement of sleeve connector 7 is accomplished by gripper Q which grasps this sleeve connector (the gripper is in the condition illustrated in FIG. 9), gripper Q itself being moved in the direction of arrow $F_5$ by the action, on pushrods 35 and 36, of plate 32 which is moved in this direction by carriage 31 actuated by jack 30 controlled by the central control station. The plugging-in is accomplished by pushing the sleeve connector 7 into a recess or socket 5*b* (FIG. 4).

When jack 30 acts on plate 32 to move it in the opposite direction to arrow $F_5$, two cases are possible:

(a) The sleeve connector 7 has not been perfectly snap-fitted in the corresponding socket of the box. In this case, the two springs 39 and 40 urge the two heads 41 and 42 and consequently the pushrods 35 and 36 rearwards (in the opposite direction to arrow $F_5$). Under these conditions, gripper Q, driven by the two pushrods 35 and 36, moves back in the opposite direction to arrow $F_5$ without opening (see FIG. 6) without releasing wire 6. The gripper will be released subsequently when drum 18, during its rotation, causes the gripper to meet the fixed cam Z (FIG. 6) which acts on pin 57 to move it in the opposite direction to that of arrow $F_5$, which frees pusher 44 from the gripper which moves once again under the action of spring 49 in the direction opposite to that of arrow $F_6$.

The releasing of pusher 44 and so the freeing of the conductor 6 not snap-fitted into the box takes place after a 30° rotation of drum 18 from the vertical position of gripper Q in which it has grasped conductor 6. A receptacle may be provided for collecting these non-fitted wires.

(b) The sleeve connector 7 has been properly snap-fitted into the corresponding socket of the box. In this case, the two springs 39 and 40 begin to push shaft 35 and 36 rearward (in the direction opposite that of arrow $F_5$). However, in this case, shaft 36 is checked in space by means of the gripper body 50, connected to shaft 36 by screw 56, the connecting rods 45, the jaws 46, the wire 6 and box 5b which is maintained fixed in space by the box carrier B (tunnel 13 and slide 14). During this time, shaft 35 can move and its end **35*b* pulls pin 57 which cooperates with a housing 58 provided in the body 50 of the gripper (FIG. 6). Thus, under the effect of spring 49, the pusher 44 of the gripper may move upwards (in the opposite direction of arrow $F_6$), which opens the jaws 46 of the gripper which passes from the closed position of FIG. 9 to the open position of FIG. 8. The gripper jaws 46, 46 will then release the wire 6 which remains snap-fitted. The gripper Q, once open, comes back to its initial position under the effect of spring 40. This latter is calibrated, for example to 60 N, within its travel of for example 35 mm in the direction of arrow $F_5$. The calibration (for example to 60 N) is used for checking the proper snap-fitting of sleeve connector 7 in the box. It also enables the good hold of the crimping of the connector sleeve 7 on the end of the wire 6 to be checked. If the above-mentioned snap fit and/or the crimping do not resist a pull of 60 N, the gripper does not open and brings back the badly-crimped or badly-fitted wire with or without sleeve connector, into a position opposite boss 34**.

In the embodiment of FIGS. 1 and 2, the box carrier B only comprises movements of translation and can only present in the plugging-in position sockets aligned in one or more rows, in particular in two rows.

However, boxes are manufactured comprising sockets disposed differently. This is the case for example of box **5*c* illustrated in FIG. 12 and which comprises three elongated sockets (60*a*, 60*b*, 60*c***.

To accomplish the plugging of electrical conductors or similar elements in boxes such as **5*c*, a box carrier $B_1$ may be provided of the type illustrated in FIGS. 10 and 11** and comprising a movement of rotation, in addition to the movements of translation.

In FIG. 11 we find again the corridor A through which arrive, in the direction of arrow F, the boxes intended to receive conductors, the last position of a box in corridor A being illustrated at **5*a***.

The box carrier $B_1$ of FIGS. 10 and 11 comprises, like box B of FIGS. 1 and 2, a bore 10 which communicates with opening 8 for the passage of the boxes from position **5*a*, and a pusher 11 adapted to move in bore 10. This pusher 11 allows the successive boxes to be brought into position 5*b* in which the box is hemmed in by a tunnel 13*a* and a slide 14*a*, pusher 11 acting directly on this slide 14*a***.

The different movements of the box carrier $B_1$ are ensured as follows:

movements in both directions $F_2$, enabling particularly the box carrier $B_1$ to be brought against the corridor A (in the position shown in FIG. 11) and to move it away from this position, owing to support 61 movable in the horizontal direction;

movements in both directions $F_3$, owing to support 62 movable in the vertical direction; it is the piston rod 63 movable in both directions $F_3$ which actuates support 62;

movement in rotation in both directions $F_7$, owing to the trunion 64 rotated by the rotary actuator 65.

As in the embodiment of FIGS. 1 and 2, the movements communicated to the box carrier are carried out from a central control station which acts on support 61, piston 63 and rotary actuator 65, as well as on pusher 11.

The operation of the box carrier $B_1$ of FIGS. 10 and 11 is the following when it is operated to plug electrical conductors into sockets **60*a*, 60*b*, 60*c* successively of the box 5*c* of FIG. 12**.

The box carrier $B_1$ is first of all brought into contact with corridor A by a movement of the box carrier in direction $F_2$—; the box carrier is then in the position illustrated in FIG. 11.

Then a box present in position **5*a* is pushed from corridor A into the box carrier $B_1$ and it penetrates into bore 10 through opening 8 (the boxes in corridor A move in the direction of arrow F); through movement of pusher 11 in direction $F_1+$, this box is brought into the plugging-in position 5*b*** (at the left-hand part of box carrier $B_1$).

Then the socket **60*a* of the box carrier $B_1$ is brought opposite the conductor to be plugged in by movement, in direction $F_2+$, of support 61; the plugging in of an appropriate conductor takes place as described above when the operation of unit C of FIGS. 3 to 9** was explained.

Then a rotation of box carrier $B_1$ is initiated in direction $F_7+$, this rotation, controlled by the rotary actuator 65, bringing socket **60*b* opposite the next conductor to be plugged in; then the plugging in of the conductor is initiated, as described above with reference to FIGS. 3 to 9**.

To bring **60*c* opposite the third conductor to be plugged in, box $B_1$ is raised in the direction of $F_3+$ by actuating piston 63; then the plugging of the third conductor in socket 60*c* can be proceeded with in the same way as for the other two conductors plugged into sockets 60*a* and 60*b***.

Through the movement of slide **14*a* in the direction $F_1$—, controlled by pusher 11, the box is released in position 5*b***.

Finally, by a movement in the direction of arrows $F_3$— (due to piston 63) and $F_7$— (due to actuator 65), the box carrier $B_1$ is brought back to the starting position and a new cycle can be initiated which begins by a movement in direction $F_2$—.

Apart from the differences pointed out, the embodiment of the box carrier $B_1$ of FIGS. 10 and 11 is similar to box carrier B of FIGS. 1 and 2 and it cooperates in a similar manner with unit C for feeding and plugging in the conductors illustrated in FIGS. 3 to 9.

Finally, it can be seen that the device of the invention permits:

(1) owing to the box carrier, boxes to be received from the feeding means, these latter to be rotated 90° and to be brought finally successively into a position fixed in space in which they are maintained for receiving a wire to be plugged in; furthermore the box carrier permits the box to be moved in order to bring successively the different sockets into position by translations, and, if required, by rotation;

(2) owing to the unit for feeding and plugging in the conductors, the wires or conductors supplied by the feeding means to be successively taken charge of, these wires to be transported to their plugging-in position, the wires transported to be plugged into the appropriate socket of the box considered, the proper snap-fitting into the box of each wire to be checked and finally the wires which have been badly fitted to be separated.

There is thus obtained a device which accomplishes in an absolutely automatic way, under the control of a central control station sending successions of pulses to be above-mentioned different jacks and step-by-step motor, the plugging with snap-fitting of conductors or wires into a box, as well as, in the preferred embodiment, the checking of the proper snap-fitting with elimination of the conductors not efficiently fitted.

As is evident and as it follows moreover already from what has gone before, the invention is in no wise limited to those of its modes of application and embodiment which have been more specially considered; it embraces, on the contrary, all variations thereof.

I claim:

1. A device for fitting the ends of electrical conductors or similar elements into a box, said device being operated in cooperation with a fixed supply corridor, adapted to feed a succession of suitably orientated boxes, and a transporter of conductors or wires, adapted to bring in a predetermined order a succession of conductors comprising at least one free end, with the free end of each successive conductor in a well-defined position; said device including a box carrier comprising means for receiving a box from a supply corridor and means for bringing this box into a predetermined succession of well-defined fixed positions, in each of which a well-defined recess or socket of this box occupies a position fixed in space, and means for releasing this box once it is provided with its conductors; and a unit for feeding and plugging in successive conductors or wires comprising grasping means adapted to grasp and release a conductor, means for bringing these grasping means opposite a conductor brought into position by a transporter, means for controlling the grasping of this conductor by said grasping means, means for bringing said grasping means and a conductor grasped thereby opposite said position fixed in space occupied by a well-defined recess of a box held by said box carrier, means for moving said grasping means so as to plug a free end of a conductor held by the grasping means into this well-defined recess and to ensure snap-fitting of this free end into this recess, and means for releasing this conductor from said grasping means.

2. A device according to claim 1 in which said box carrier also comprises a bore having a longitudinal axis with a lateral opening through which it receives boxes in succession, pushing means adapted to move longitudinally in said bore to push a box from said lateral opening to a plugging-in position, and actuating means adapted to move said pushing means in both directions, along said longitudinal axis.

3. A device according to claim 2 in which said box carrier also comprises a lateral opening for introducing boxes in succession, a bore communicating with said opening to receive such boxes in succession, a pusher adapted to move in said bore, means for maintaining a box in a position fixed in space and comprising fixed means and movable means integral with said pusher, and means for moving the pusher in the bore in both directions.

4. A device according to claim 2 or 3 in which the box carrier also comprises means for moving a box in both directions, along two orthogonal paths orthogonal to each other and to said longitudinal axis, one path corresponding to the passage from one conductor recess or socket to the following one in the same row in the plugging in position and the other path corresponding to the bringing of the box carrier against the outlet end of a supply corridor and also to the passage from one socket of one row to a socket of another row, in the plugging-in position.

5. A device according to claim 4, characterized by the fact that the box carrier comprises furthermore means for moving a box in rotation about said longitudinal axis.

6. A device according to claim 1, 2 or 3 also including means for moving said grasping means toward and away from said box carrier.

7. A device according to claim 1, 2 or 3 in which the feeding and plugging-in unit also comprises checking means which, after plugging in of a conductor determines whether a conductor snap fitted in a box recess resists a definite strain, and means which frees a conductor from said grasping means in said predetermined position only if said checking means have checked that there is a snap fitting of a conductor in a box recess.

8. A device according to claim 1, 2 or 3 in which said unit for feeding and plugging in conductors also comprises a drum rotatable about a fixed axis, means for rotating said drum step-by-step about said fixed axis to occupy a succession of angularly displaced positions, a bore provided in the body of the drum, a carriage adapted to move in said bore, means for moving the carriage in said bore in both directions, said means for transmitting the movements of the carriage to said grasping means.

9. A device according to claim 8 in which said means for transmitting movement to said grasping means comprises a control element carried by said drum, a plate carried by said drum, first and second pushrods carried by the grasping means and movable in relation thereto, said pushrods cooperating with said control element and with the plate, a return element surrounding each of said pushrods and ensuring the application of the ends of the pushrods against the control element or the plate.

10. A device according to claim 9 in which a first of the return elements is calibrated to the strength to which a snap fit must resist, means being provided for opening the grasping means only when the snap fit resists a pull applied to a snap-fitted conductor and corresponding to the calibration of said first return element.

* * * * *